US007895765B2

(12) United States Patent
Plain

(10) Patent No.: US 7,895,765 B2
(45) Date of Patent: Mar. 1, 2011

(54) BROW TOOL

(76) Inventor: Natalie Plain, Beverly Hills, CA (US)

( * ) Notice: Subject to any disclaimer, the term of this patent is extended or adjusted under 35 U.S.C. 154(b) by 101 days.

(21) Appl. No.: 12/456,200

(22) Filed: Jun. 13, 2009

(65) Prior Publication Data

US 2010/0229886 A1 Sep. 16, 2010

Related U.S. Application Data

(63) Continuation-in-part of application No. 29/314,170, filed on Mar. 10, 2009, now Pat. No. Des. 613,455.

(51) Int. Cl.

| | |
|---|---|
| ***G01B 3/16*** | (2006.01) |
| ***A61B 1/00*** | (2006.01) |
| ***A61B 5/103*** | (2006.01) |
| ***A61B 5/117*** | (2006.01) |

(52) U.S. Cl. ..... 33/558.01; 33/512

(58) Field of Classification Search ..... 33/558.01, 33/558.02, 558.03, 558.04, 501.7, 501.13, 33/784, 783, 794, 797, 27.02, 30.1, 663–666, 33/558.2, 558.4

See application file for complete search history.

(56) References Cited

U.S. PATENT DOCUMENTS

| | | | | | |
|---|---|---|---|---|---|
| 297,492 | A * | 4/1884 | Bovensiep | 33/558.04 |
| 709,738 | A * | 9/1902 | Brandell | 33/27.02 |
| 2,487,451 | A * | 11/1949 | Kurmer | 33/558.02 |
| 3,300,864 | A * | 1/1967 | Lesslie | 33/512 |
| 4,118,870 | A * | 10/1978 | Dyson | 33/512 |
| 4,163,322 | A * | 8/1979 | Partes | 33/27.02 |
| 5,115,571 | A * | 5/1992 | Mackin | 33/558.04 |
| 5,327,907 | A * | 7/1994 | Fischer | 600/587 |
| 5,430,954 | A * | 7/1995 | Best et al. | 33/793 |
| 5,473,940 | A * | 12/1995 | Parker | 73/487 |
| 5,875,561 | A * | 3/1999 | Chen et al. | 33/784 |
| 6,497,051 | B1 * | 12/2002 | Poole et al. | 33/784 |
| 7,640,671 | B1 * | 1/2010 | Tu | 33/27.02 |
| D613,455 | S * | 4/2010 | Plain | D28/10 |
| 7,699,607 | B2 * | 4/2010 | Margossian | 33/513 |
| 2010/0229886 | A1 * | 9/2010 | Plain | 132/216 |

* cited by examiner

*Primary Examiner*—Yaritza Guadalupe-McCall
(74) *Attorney, Agent, or Firm*—Clement Cheng

(57) ABSTRACT

A brow tool comprises a first extending arm. The first extending arm has a first gear at a base portion. A first straight edge is defined on an inside portion of the first extending arm. The first straight edge is offset in a latitudinal direction in the amount of one half of a gap distance, to provide a latitudinal offset. A second extending arm has a second gear at a base portion. A second straight edge is defined on an inside portion of the second extending arm. The second straight edge is offset in a latitudinal direction to provide a latitudinal offset in the amount of one half of a gap distance. A housing connects the first gear to the second gear so that the first gear is in meshed configuration with the second gear.

20 Claims, 10 Drawing Sheets

BROW TOOL

This application is a continuation in part of Ser. No. 29/314,170 and claims priority from design patent application filed entitled Brow Tool to same inventor Natalie Plain filed Mar. 10, 2009 now U.S. Pat. No. D,613,455.

DISCUSSION OF RELATED ART

Brow styling is an ancient art requiring skill and patience. Typically, it is difficult for a novice to style brows without assistance. Because eye brows do not regrow easily, errors in brow styling can cause semi permanent cosmetic damage which is difficult to correct using cosmetics.

SUMMARY OF THE INVENTION

The present invention is a brow tool allowing a user to align and measure key metrics in brow styling. The present invention is an apparatus that has a bottom joint and a pair of extending arms extending from the bottom joint. The pair of extending arms have an inside edge spaced approximately 1 inch apart from each other. The pair of extending arms swivel relative to each other and provide a guide for defining a tweezing area.

To use the invention, a user first closes the brow tool so that the pair of extending arms have an inside edge parallel to each other. The user aligns the inside edge vertically to extend over the inside brow area to define a start line A. The user then extends one arm of the brow tool so that the inside edge of the extended arm is aligned with the outer edge of the iris. The portion of the inside edge of the extended arm extends over the brow to define an arch line B. The user then extends the extended arm to increase the angle of the brow tool until the inside edge is aligned with the outer edge of the eye to define an end line C. The inside edge of the extended arm extends over the brow to define end line C.

The brow tool then fully extends to an angle greater than 90° so that an inside edge of extended arm can be placed just below the bottom of the brow, with the arm resting on the area between the user's eyes. The user draws a first line to connect the start line A with the arch line B. The extended arm inside edge then provides a guide for a second line drawn between arch line B and end line C. The user then uses the straight edge inside edge to confirm that the brows are of the same height. The user then repeats the steps on the other eye.

The user therefore defines a tweezing area for tweezing the area between the pair of start lines A, and the area below the first line and the second line. The first line and the second line define an angle greater than 90°.

Figure 1:
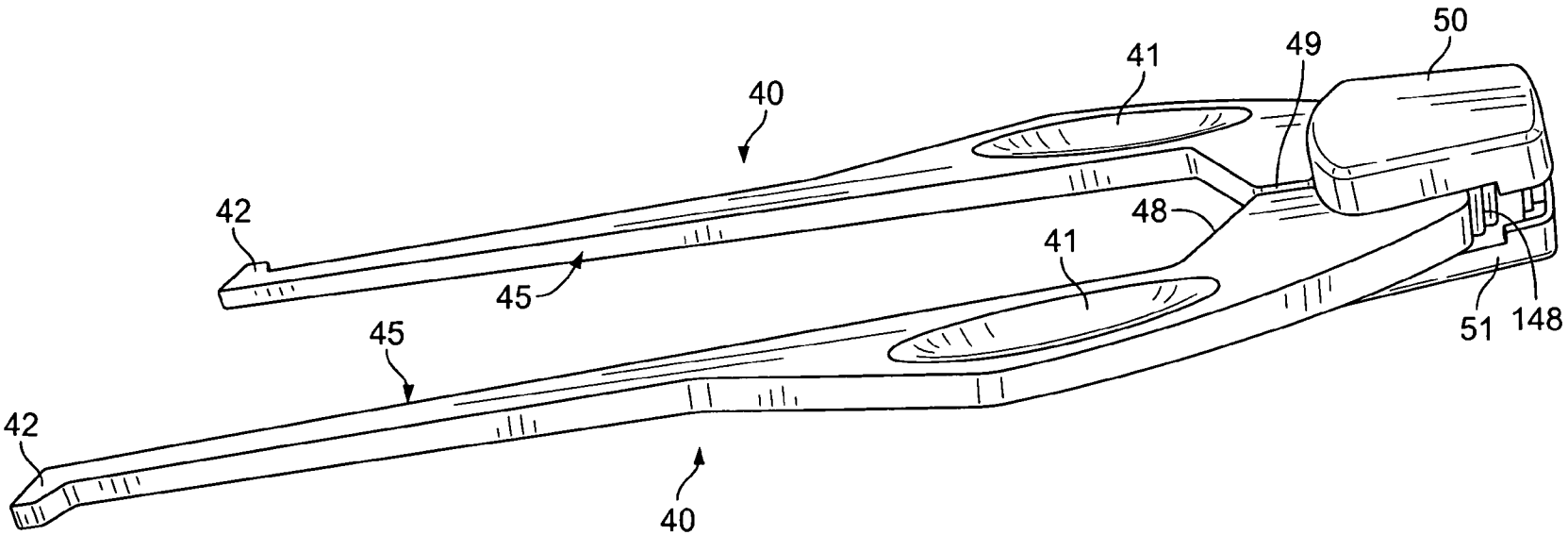
FIG. 1 is a perspective view of the brow tool exterior in the closed position.
Figure 2:
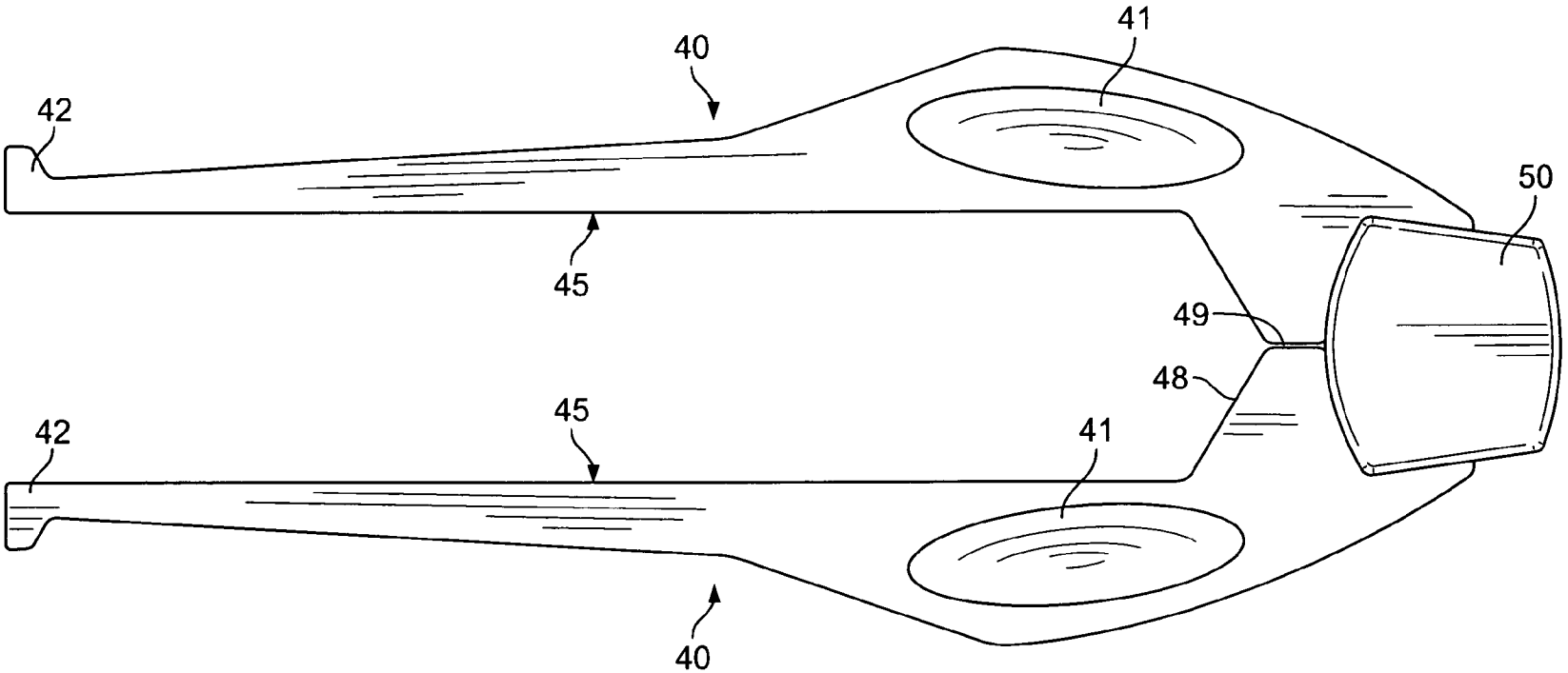
FIG. 2 is a front view of the brow tool in closed position.
Figure 3:
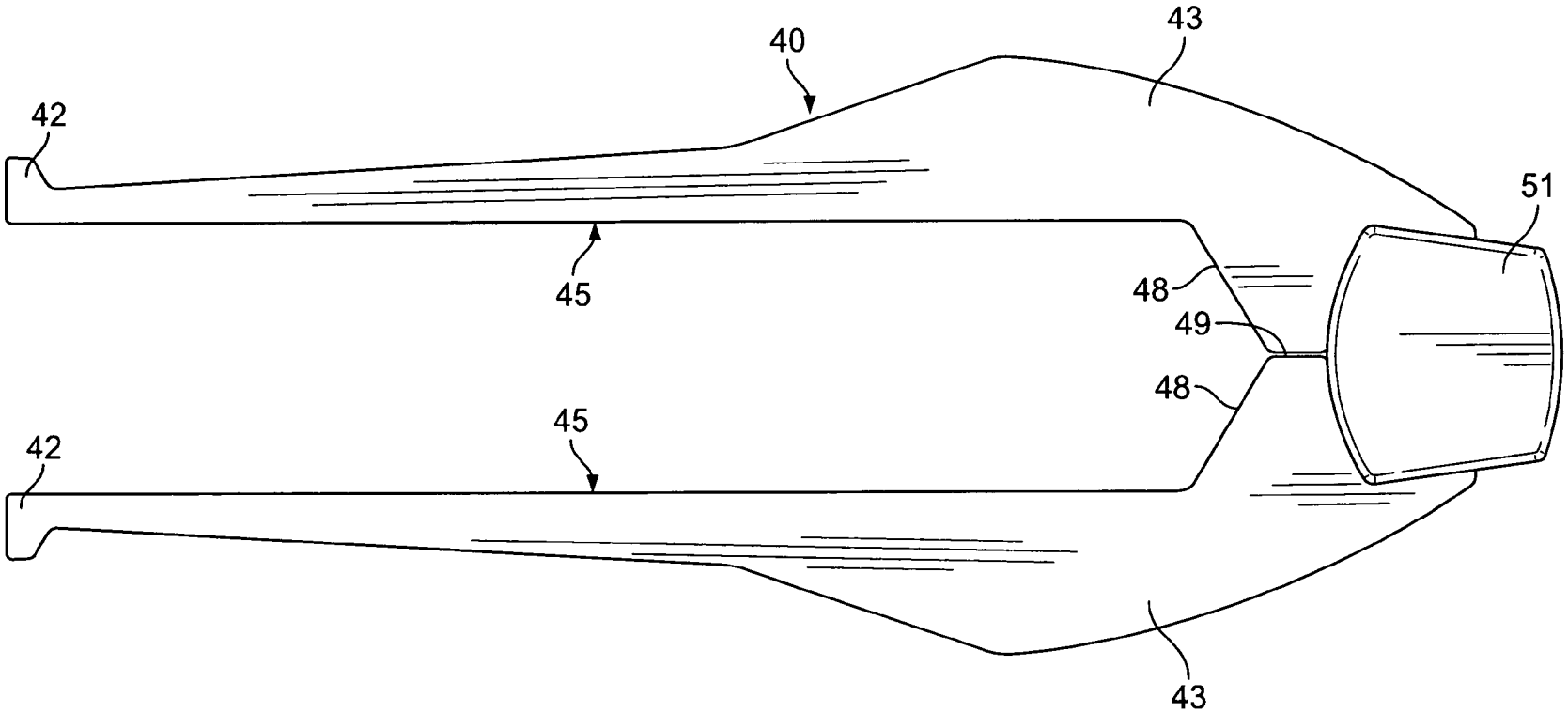
FIG. 3 is a rear view of the brow tool in closed position.
Figure 4:
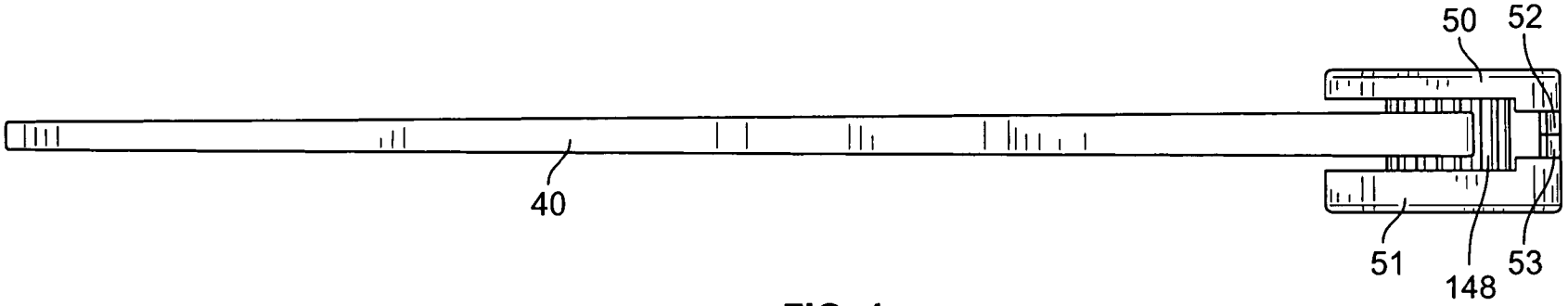
FIG. 4 is a left view of the brow tool in closed position.
Figure 5:
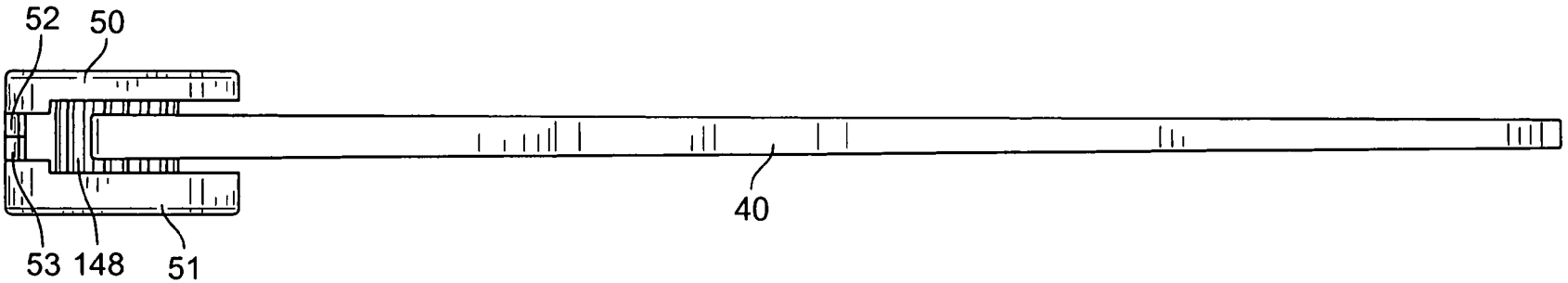
FIG. 5 is a right view of the brow tool in closed position.
Figure 6:
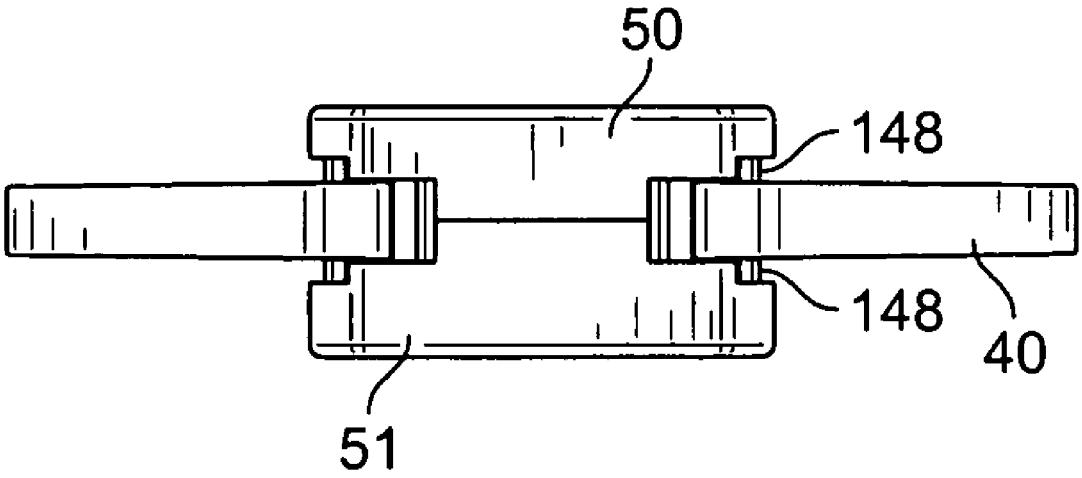
FIG. 6 is a bottom view of the brow tool in closed position.
Figure 7:
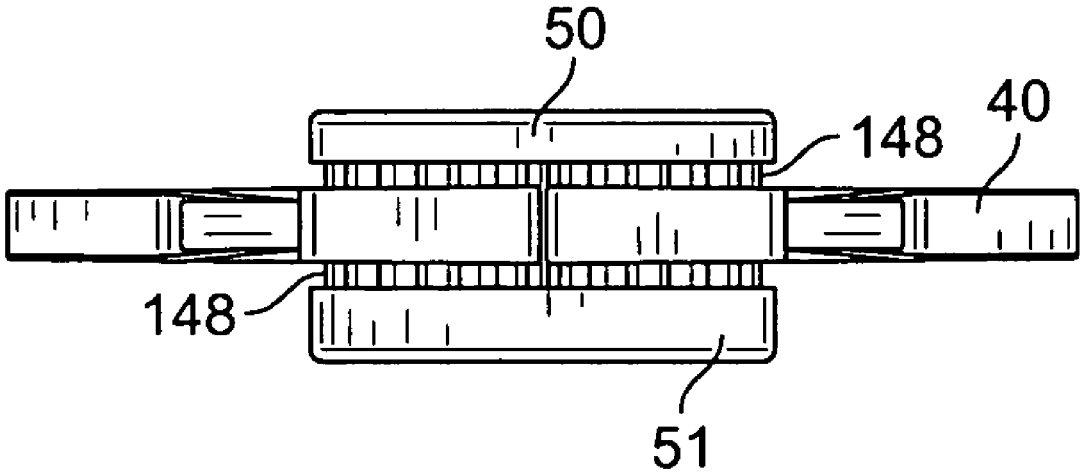
FIG. 7 is a top view of the brow tool in closed position.
Figure 8:
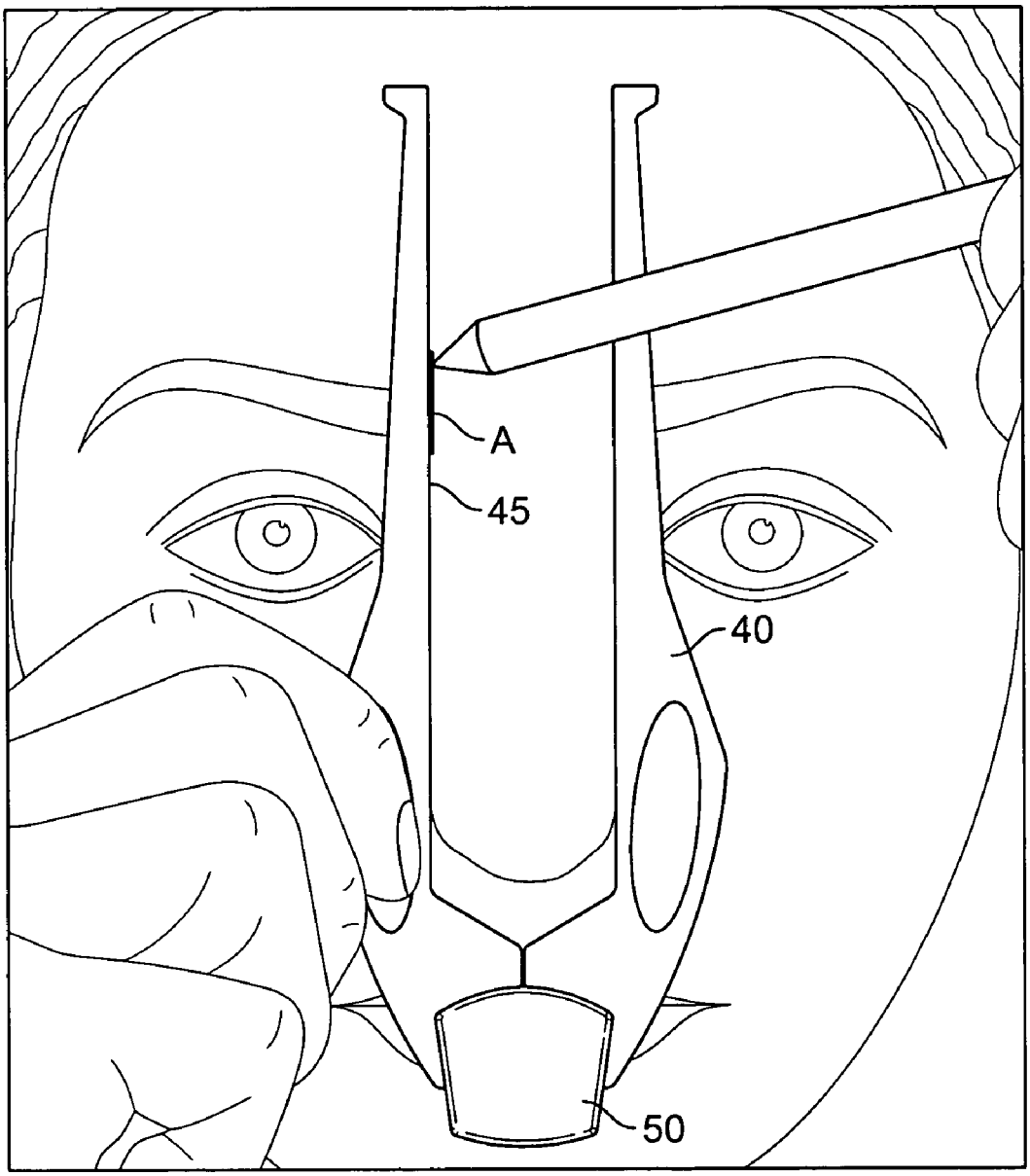
FIG. 8 is a diagram of drawing the start line.
Figure 9:
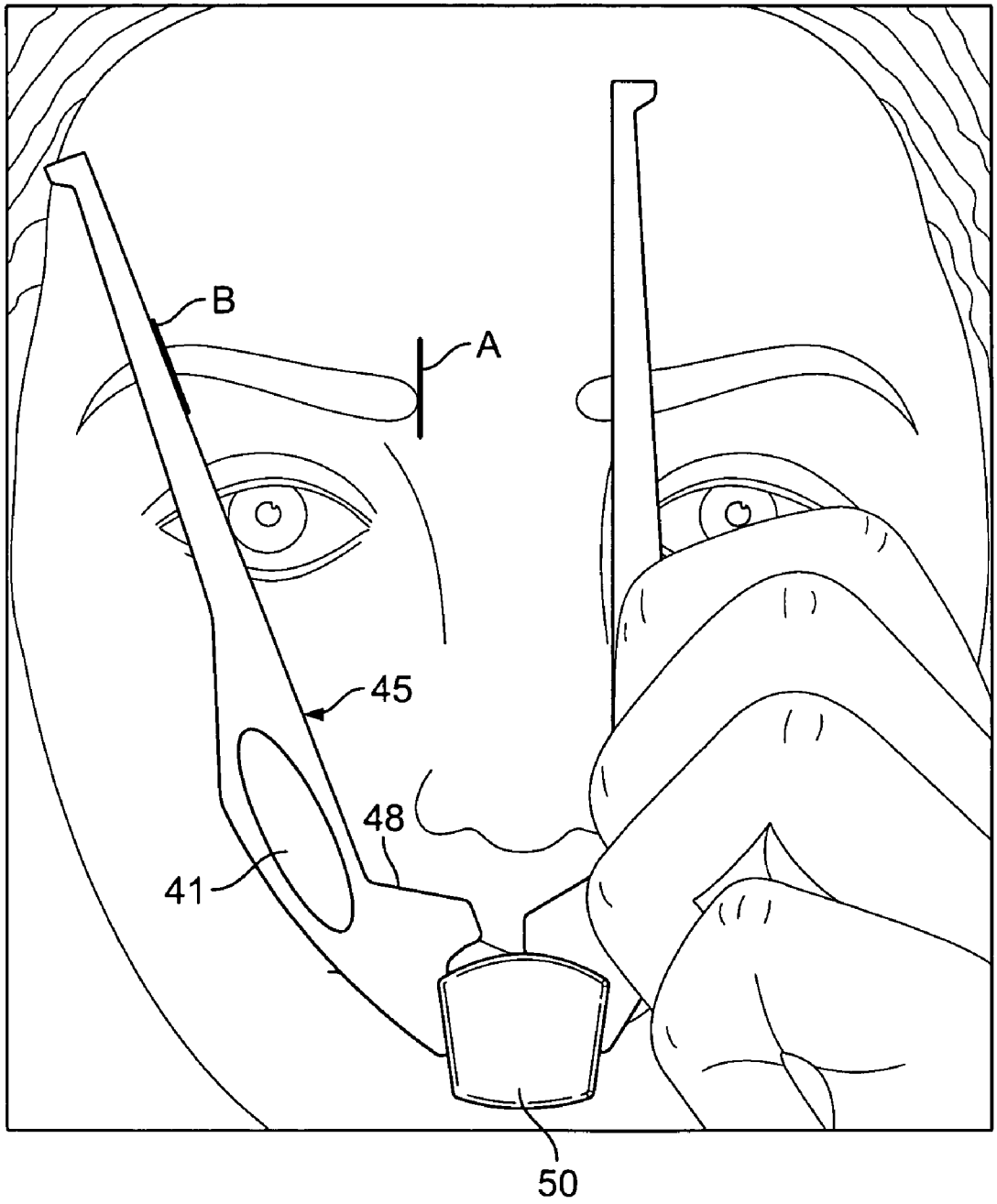
FIG. 9 is a diagram of drawing the arch line.
Figure 10:
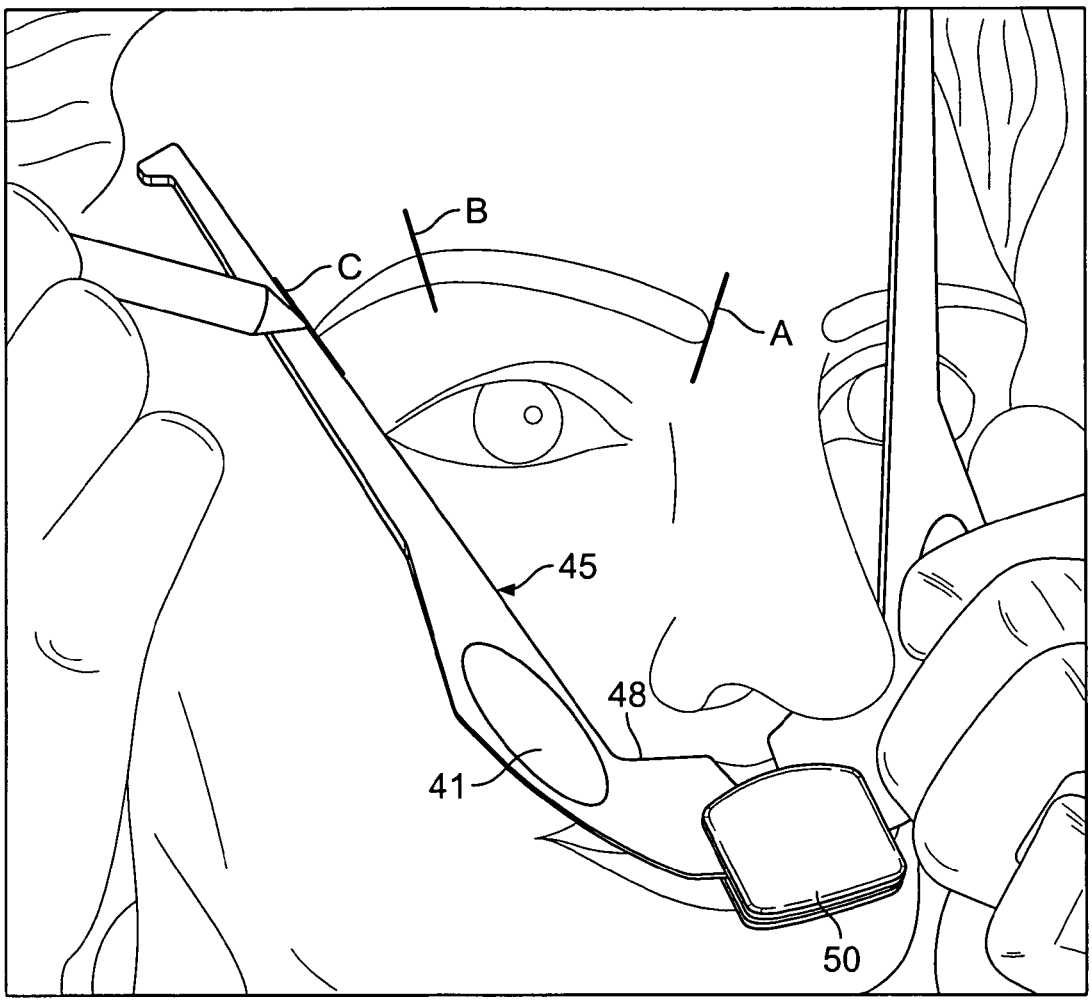
FIG. 10 is a diagram of drawing the end line.

The following call out list of elements is a helpful guide for understanding the brief description of the drawings.

40 extending arm
41 grip depression
42 hook ending
43 flat portion
45 straight edge
48 inside angle
49 abutting line
50 housing top
51 housing bottom
52 housing top joiner
53 housing bottom joiner
148 gear
A start line
B arch line
C end line

DETAILED DESCRIPTION OF THE PREFERRED EMBODIMENT

The present invention as seen in FIGS. 1-7, is a brow tool which has a variety of features for drawing brow defining lines. A user can use the brow tool for drawing brow defining lines to define an area in which to tweeze the eyebrows. The first extending arm and the second extending arm rotate relative to each other so that they can be rotated away from each other. The first extending arm and the second extending arm are adapted to angular extension from an initial 0° angle to a 180° angle.

The brow tool in the best mode has a total of four parts. The first and second part are a pair of extending arms 40. Each extending arm 40 has a grip depression 41 disposed on a surface of the extending arm 40. The extending arm 40 also has an inside edge 45 and each inside straight edge 45 has a hook ending 42. The extending arms 40 have an inside angle 48 which is formed as an edge which joins the inside straight edge 45 to the abutting line 49. The abutting line 49 is comprised of a pair of surfaces in parallel abutment to each other. The parallel abutment of the abutting line 49 when oriented by inside angle 48 extends to a pair of straight edges 45 on inside surfaces of the pair of extending arms 40. The straight edges 45 are substantially parallel to each other. The extending arm 40 terminates in a hook ending 42 having a flat tip.

The third and fourth part of the brow tool are housing members that cover the base portion of the brow tool. The top housing member 50 and the bottom housing member 51 each have a joining portion, namely a housing top joiner 52 and a housing bottom joiner 53. The housing top joiner is joined to the housing bottom joiner. The housing top joiner and housing bottom joiner may join at an interface that is elongated. Alternatively, the housing top joiner and housing bottom joiner can be joined at an interface which is discontinuous. The housing top joiner joins with the housing bottom joiner at a joining line.

The housing retains a pair of gears in meshed configuration 148. A pair of protrusions can extend from each housing member and act as an axle for rotation of the gears 148. Because gears 148 are meshed together, the angle of each extending arm from the median line of symmetry is equal. The pair of extending arms 40 have a defined gap between the straight edges 45. The gap is preferably sized and predefined to the average width of a nose.

The pair of meshed gears is offset from the straight edge by the dimensions of the inside angle area of the extending arms. The offset is comprised of a latitudinal component and a longitudinal component. The latitudinal offset is one half of the a gap distance in a latitudinal direction which is provided by the inside angle area. The offset has a longitudinal component which is the distance between the straight edge 45 and the axis of rotation on the gear.

The straight edges 45 are initially parallel, and can be turned so that they oppose each other in parallel configuration. The opposition in parallel configuration occurs when the straight edges are pulled so that they point away from each other in 180° configuration. In 180° configuration, the hook endings 42 also point away from each other. The largest angle is constricted, calibrated and produced by the abutment of the extending arm against the housing. The smallest angle is constricted, calibrated and produced by the abutment of abutment areas dispose on the first extending arm and the second extending arm.

The gears have a space between them. The space between the gears is predefined as a gear spacing. The gears do not have a drive ratio of 1:1 and are preferably the same dimension, size and same material. The best mode is when the distance between the axis of the gears is approximately 0.5 cm so that the diameter of a gear is also 0.5 cm. The gap distance is approximately 1 inch which is an inch with a variance of greater or lesser than an inch by about half an inch. The extending arms are preferably formed as planar elongated members of about 5 inches long.

Figure 11:
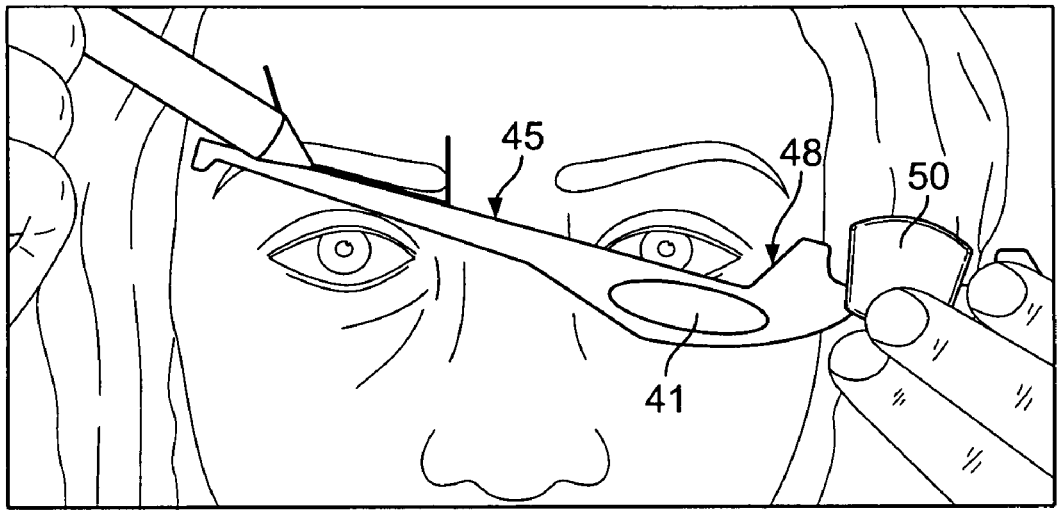
FIG. 11 is a diagram of drawing a connection between the start line and the arch line.
Figure 12:
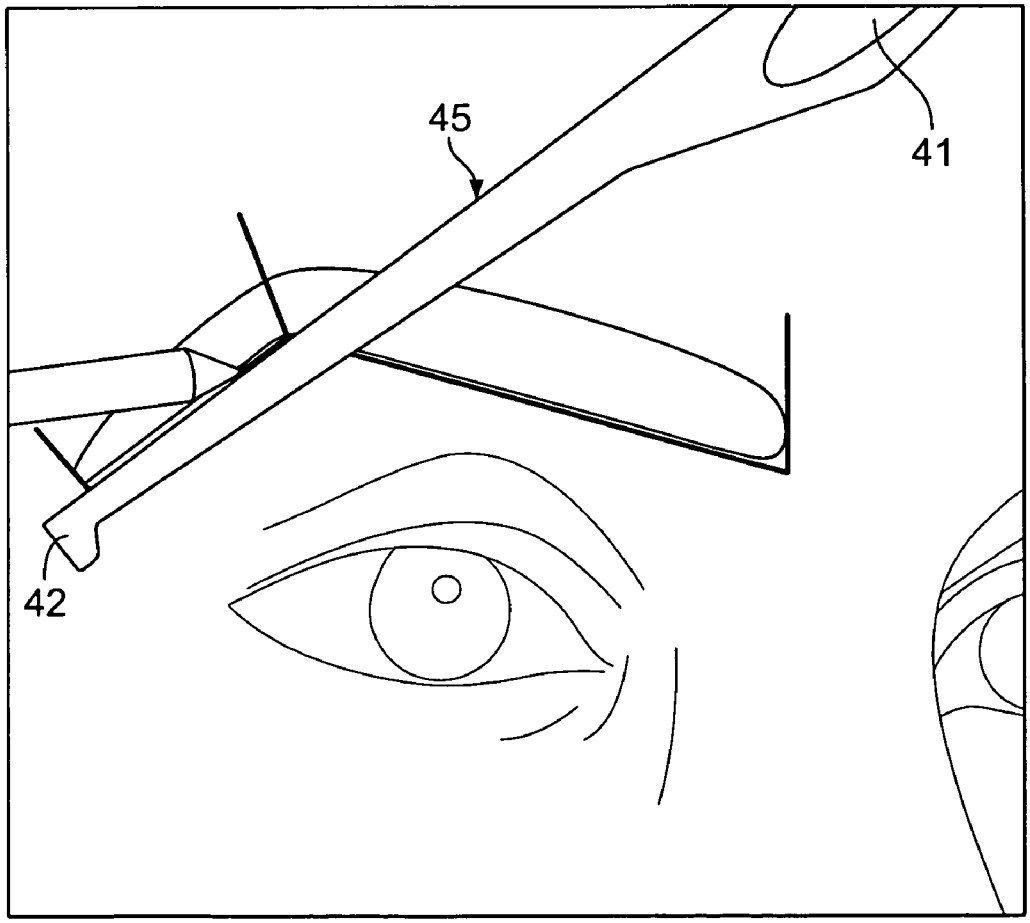
FIG. 12 is a diagram of drawing a connection between the arch line and the end line.
Figure 13:
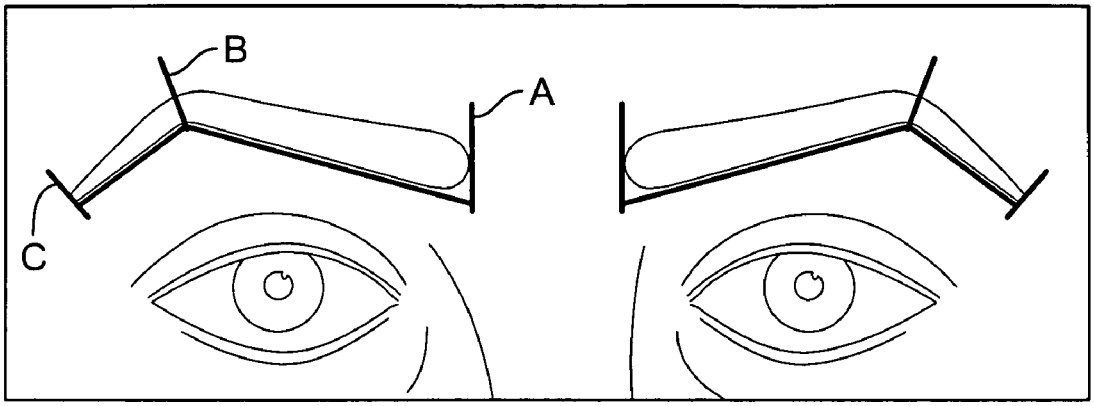
FIG. 13 is a diagram of the completed lines.

The extending arms have a first position, FIG. 1 which is a starting position and a second position FIG. 11 which is an ending position. At the starting position, the first and second angle can be defined. A first angle is defined as the angle between a median lengthwise line and the first straight edge, and a second angle is defined as the angle between the median lengthwise line and the second straight edge. The first gear and the second gear are configured so that the first angle and the second angle remain approximately equal throughout angular extension of the first extending arm and the second extending arm.

FIGS. 8-13 shows usage of the brow tool. To use the invention, a user first closes the brow tool so that the pair of extending arms have an inside edge parallel to each other. The user aligns the inside edge vertically to extend over the inside brow area to define a start line A. The user then extends one arm of the brow tool so that the inside edge of the extended arm is aligned with the outer edge of the iris. The portion of the inside edge of the extended arm extends over the brow to define an arch line B. The user then extends the extended arm to increase the angle of the brow tool until the inside edge is aligned with the outer edge of the eye to define an end line C. The inside edge of the extended arm extends over the brow to define end line C.

The brow tool then fully extends to an angle greater than 90° so that an inside edge of extended arm can be placed just below the bottom of the brow, with the arm resting on the area between the user's eyes. The user draws a first line to connect the start line A with the arch line B. The extended arm inside edge then provides a guide for a second line drawn between arch line B and end line C. The user then uses the straight edge inside edge to confirm that the brows are of the same height. The user then repeats the steps on the other eye.

The user therefore defines a tweezing area for tweezing the area between the pair of start lines A, and the area below the first line and the second line. The first line and the second line define an angle greater than 90°.

The invention claimed is:

1. A brow tool comprising:

a. a first extending arm; wherein the first extending arm has a first gear at a base portion;

b. a first straight edge defined on an inside portion of the first extending arm, wherein the first straight edge is offset in a latitudinal direction in the amount of one half of a gap distance, to provide a latitudinal offset;

c. a second extending arm; wherein the second extending arm has a second gear at a base portion;

d. a second straight edge defined on an inside portion of the second extending arm, wherein the second straight edge is offset in a latitudinal direction to provide a latitudinal offset in the amount of one half of a gap distance, wherein the gap distance is the distance between the first straight edge and the second straight edge, wherein the first straight edge and the second straight edge are facing each other, wherein the gap distance is approximately 1 inch;

e. a housing connecting the first gear to the second gear so that the first gear is in meshed configuration with the second gear.

2. The brow tool of claim 1, further comprising a first angle defined as the angle between a median lengthwise line and the first straight edge, and a second angle defined as the angle between the median lengthwise line and the second straight edge; wherein the first gear and the second gear are configured so that the first angle and the second angle remain approximately equal throughout angular extension of the first extending arm and the second extending arm.

3. The brow tool of claim 1, further comprising a first grip on the first extending arm, and a second grip on the second extending arm, wherein the first grip is disposed on an upper surface of the first extending arm, wherein the first extending arm is formed as an elongated planar member, wherein the second grip is disposed on an upper surface of the second extending arm, wherein the second extending arm is formed as an elongated planar member.

4. The brow tool of claim 1, further comprising a first hook ending having a flat tip disposed on the first extending arm, and a second hook ending having a flat tip disposed on the second extending arm.

5. The brow tool of claim 1, wherein the diameter of a gear is approximately 0.5 cm.

6. The brow tool of claim 1, wherein the first extending arm in the seconding extending arm are both approximately 5 inches long.

7. The brow tool of claim 1, further comprising a first inside angle area defining a first longitudinal offset predetermined as the distance between the first straight edge and the first gear; and further comprising a second inside angle area defining a second longitudinal offset predetermined as the distance between the second straight edge and the second gear, wherein the housing comprises a housing top portion, and a housing bottom portion, wherein the housing top portion has a housing top joiner, wherein the housing bottom portion has a housing bottom joiner, wherein the housing top joiner joins with the housing bottom joiner at a joining line.

8. The brow tool of claim 7, further comprising a first angle defined as the angle between a median lengthwise line and the first straight edge, and a second angle defined as the angle between the median lengthwise line and the second straight edge; wherein the first gear and the second gear are configured so that the first angle and the second angle remain approximately equal throughout angular extension of the first extending arm and the second extending arm.

9. The brow tool of claim 8, further comprising a first grip on the first extending arm, and a second grip on the second extending arm, wherein the first grip is disposed on an upper surface of the first extending arm, wherein the first extending arm is formed as an elongated planar member, wherein the second grip is disposed on an upper surface of the second extending arm, wherein the second extending arm is formed as an elongated planar member.

10. The brow tool of claim 9, further comprising a first hook ending having a flat tip disposed on the first extending arm, and a second hook ending having a flat tip disposed on the second extending arm.

11. The brow tool of claim 9, wherein the diameter of a gear is approximately 0.5 cm.

12. The brow tool of claim 9, wherein the first extending arm in the seconding extending arm are both approximately 5 inches long.

13. The brow tool of claim 1, further comprising a first inside angle area defining a first longitudinal offset predetermined as the distance between the first straight edge and the first gear; and further comprising a second inside angle area defining a second longitudinal offset predetermined as the distance between the second straight edge and the second gear, wherein the housing comprises a housing top portion, and a housing bottom portion, wherein the housing top portion has a housing top joiner, wherein the housing bottom portion has a housing bottom joiner, wherein the housing top joiner joins with the housing bottom joiner at a joining line.

14. The brow tool of claim 13, further comprising a first angle defined as the angle between a median lengthwise line and the first straight edge, and a second angle defined as the angle between the median lengthwise line and the second straight edge; wherein the first gear and the second gear are configured so that the first angle and the second angle remain approximately equal throughout angular extension of the first extending arm and the second extending arm.

15. The brow tool of claim 14, further comprising a first grip on the first extending arm, and a second grip on the second extending arm, wherein the first grip is disposed on an upper surface of the first extending arm, wherein the first extending arm is formed as an elongated planar member, wherein the second grip is disposed on an upper surface of the second extending arm, wherein the second extending arm is formed as an elongated planar member.

16. The brow tool of claim 1, wherein the housing comprises a housing top portion, and a housing bottom portion, wherein the housing top portion has a housing top joiner, wherein the housing bottom portion has a housing bottom joiner, wherein the housing top joiner joins with the housing bottom joiner at a joining line.

17. The brow tool of claim 1, further comprising a first hook ending having a flat tip disposed on the first extending arm, and a second hook ending having a flat tip disposed on the second extending arm, wherein the diameter of a gear is approximately 0.5 cm, wherein the first extending arm in the seconding extending arm are both approximately 5 inches long.

18. The brow tool of claim 1, further comprising a first position where the first straight edge and second straight edge are parallel at 0° from each other, and further comprising a second position where the first straight edge and the second straight edge are at 180° from each other; wherein the first position is the smallest angle formed by an abutting line of a pair of abutting surfaces disposed on the first straight edge and the second straight edge, and wherein the second position is the largest angle formed by abutment of the first extending arm abutting against the housing, and formed by the abutment of the second extending arm abutting against the housing.

19. The brow tool of claim 18, wherein the housing comprises a housing top portion, and a housing bottom portion, wherein the housing top portion has a housing top joiner, wherein the housing bottom portion has a housing bottom joiner, wherein the housing top joiner joins with the housing bottom joiner at a joining line.

20. The brow tool of claim 19, further comprising a first angle defined as the angle between a median lengthwise line and the first straight edge, and a second angle defined as the angle between the median lengthwise line and the second straight edge; wherein the first gear and the second gear are configured so that the first angle and the second angle remain approximately equal throughout angular extension of the first extending arm and the second extending arm.

* * * * *